US010452023B2

(12) United States Patent
Nakajima et al.

(10) Patent No.: US 10,452,023 B2
(45) Date of Patent: Oct. 22, 2019

(54) IMAGE FORMING APPARATUS AND DRUM CARTRIDGE

(71) Applicant: Brother Kogyo Kabushiki Kaisha, Nagoya-shi, Aichi-ken (JP)

(72) Inventors: Keigo Nakajima, Nagoya (JP); Mayu Wakamatsu, Inazawa (JP); Masatoshi Shiraki, Nagoya (JP); Kei Katagiri, Nagoya (JP); Shota Iriyama, Toyokawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/026,146

(22) Filed: Jul. 3, 2018

(65) Prior Publication Data

US 2019/0011874 A1 Jan. 10, 2019

(30) Foreign Application Priority Data

Jul. 6, 2017 (JP) ..... 2017-133079

(51) Int. Cl.
*G03G 21/18* (2006.01)

(52) U.S. Cl.
CPC ..... *G03G 21/1832* (2013.01); *G03G 21/1814* (2013.01); *G03G 21/1846* (2013.01); *G03G 2221/1612* (2013.01)

(58) Field of Classification Search
CPC ..... G03G 21/1814; G03G 21/1846; G03G 21/1832; G03G 2221/1612
See application file for complete search history.

(56) References Cited

U.S. PATENT DOCUMENTS

| | | | | |
|---|---|---|---|---|
| 5,113,220 | A * | 5/1992 | Kwak | G03G 21/1832 399/114 |
| 6,236,822 | B1 * | 5/2001 | Kawaguchi | G03G 21/1832 399/114 |
| 2011/0170906 | A1 * | 7/2011 | Matsushita | G03G 21/1832 399/114 |
| 2017/0075292 | A1 | 3/2017 | Nagae et al. | |

FOREIGN PATENT DOCUMENTS

| | | |
|---|---|---|
| JP | 2006-003690 A | 1/2006 |
| JP | 2017-058517 A | 3/2017 |

* cited by examiner

*Primary Examiner* — Rodney A Bonnette
(74) *Attorney, Agent, or Firm* — Banner & Witcoff, Ltd.

(57) ABSTRACT

There is provided an image forming apparatus including a casing and a drum cartridge. The drum cartridge includes: a photosensitive drum having a circumferential surface which includes a first area and a second area; a first cover which pivotally moves between a first closed position where the first cover covers the first area of the photosensitive drum and a first open position where the first area is exposed; and a second cover which pivotally moves between a second closed position where the second cover covers the second area of the photosensitive drum and a second open position where the second area is exposed. A direction in which the second cover pivotally moves from the second closed position to the second open position is opposite to a direction in which the first cover pivotally moves from the first closed position to the first open position.

19 Claims, 10 Drawing Sheets

IMAGE FORMING APPARATUS AND DRUM CARTRIDGE

CROSS REFERENCE TO RELATED APPLICATION

The present application claims priority from Japanese Patent Application No. 2017-133079 filed on Jul. 6, 2017, the disclosure of which is incorporated herein by reference in its entirety.

BACKGROUND

Field of the Invention

The present disclosure relates to an image forming apparatus and a drum cartridge.

Description of the Related Art

There is conventionally known an image forming apparatus including a casing and a drum cartridge. The drum cartridge is installable in the casing. The drum cartridge includes a photosensitive drum.

SUMMARY

In the publicly known drum cartridge, a circumferential surface of the photosensitive drum may be exposed. This may dirty or damage the circumferential surface of the photosensitive drum in a state where the drum cartridge is removed from the casing.

In view of the above, an object of the present disclosure is to provide a drum cartridge that protects a circumferential surface of a photosensitive drum in a state where the drum cartridge is removed from a casing and an image forming apparatus including the drum cartridge.

An image forming apparatus of the present disclosure includes: a casing and a drum cartridge which is installable in the casing.

The drum cartridge includes a photosensitive drum, a first cover, and a second cover. The photosensitive drum has a circumferential surface which includes a first area and a second area. The first cover pivotally moves between a first closed position and a first open position. In the first closed position, the first cover covers the first area of the photosensitive drum. In the first open position, the first area is exposed. The second cover pivotally moves between a second closed position and a second open position. In the second closed position, the second cover covers the second area of the photosensitive drum. In the second open position, the second area is exposed.

A direction in which the second cover pivotally moves from the second closed position to the second open position is opposite to a direction in which the first cover pivotally moves from the first closed position to the first open position.

In that configuration, the circumferential surface of the photosensitive drum is covered with the first cover and the second cover, of the drum cartridge, pivotally moving in mutually different directions.

The circumferential surface of the photosensitive drum is thus protected by positioning the first cover in the first closed position and positioning the second cover in the second closed position, in a state where the drum cartridge is removed from the casing.

In the image forming apparatus of the present disclosure, the circumferential surface of the photosensitive drum is protected in the state where the drum cartridge is removed from the casing.

DESCRIPTION OF THE EMBODIMENTS

<First Embodiment>

An image forming apparatus 1 according to a first embodiment of the present disclosure is explained schematically.

Figure 1:
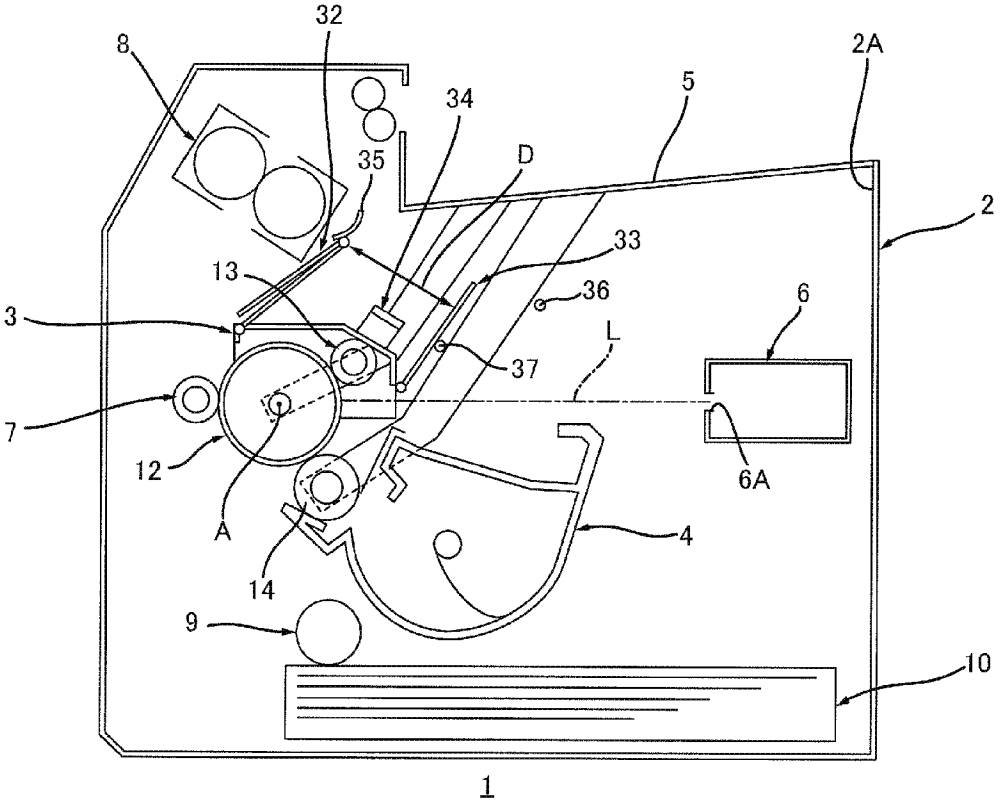
FIG. 1 depicts a schematic configuration of an image forming apparatus.

As depicted in FIG. 1, the image forming apparatus 1 includes a casing 2, a drum cartridge 3, and a developing cartridge 4.

The casing 2 has an opening 2A through which the drum cartridge 3 and the developing cartridge 4 are installed in the casing 2. The opening 2A is used not only when the drum cartridge 3 is installed in the casing 2, but also when the developing cartridge 4 is installed in the casing 2. The casing 2 includes a cover 5, an exposure unit 6, a transfer roller 7, a fixing unit 8, a feed part 9, and a feed tray 10. Namely, the image forming apparatus 1 includes the exposure unit 6 and the transfer roller 7.

The cover 5 is movable between an open position (see FIG. 2) where the opening 2A is open and a closed position (see FIG. 1) where the opening 2A is closed.

The exposure unit 6 exposes a circumferential surface of a photosensitive drum 12, which is described below. The exposure unit 6 emits a light L. Specifically, the exposure unit 6 is a laser scan unit. The exposure unit 6 has an exit aperture 6A through which the light L is emitted. The light L emitted from the exit aperture 6A passes a position above the developing cartridge 4 and below a second cover 33 in a second open position described below, and then enters the circumferential surface of the photosensitive drum 12.

The transfer roller 7 transfers a toner image formed on the circumferential surface of the photosensitive drum 12 on a sheet. The transfer roller 7 is in contact with the circumferential surface of the photosensitive drum 12 in a state where the drum cartridge 3 is installed in the casing 2.

The fixing unit 8 fixes the toner image onto the sheet by heating and pressurizing the sheet on which the toner image has been transferred. The sheet passing through the fixing unit 8 is discharged on the cover 5.

The feed part 9 supplies each sheet in the feed tray 10 to between the photosensitive drum 12 and the transfer roller 7.

The feed tray 10 houses sheets.

The drum cartridge 3 is installable in the casing 2 via the opening 2A. The drum cartridge 3 includes the photosensitive drum 12 and a charging roller 13.

The photosensitive drum 12 can rotate around a rotation axis A extending in an axis direction.

The charging roller 13 charges the circumferential surface of the photosensitive drum 12. The charging roller 13 is in contact with the circumferential surface of the photosensitive drum 12.

The developing cartridge 4 is installable in the casing 2 via the opening 2A. The developing cartridge 4 is installable in the casing 2 independently of the drum cartridge 3. The developing cartridge 4 contains a toner. The developing cartridge 4 includes the developing roller 14.

The developing roller 14 supplies the toner to the photosensitive drum 12. The developing roller 14 is in contact with the circumferential surface of the photosensitive drum 12 in a state where the drum cartridge 3 and the developing cartridge 4 are installed in the casing 2.

Subsequently, details of the casing 2 are explained.

Figure 2:
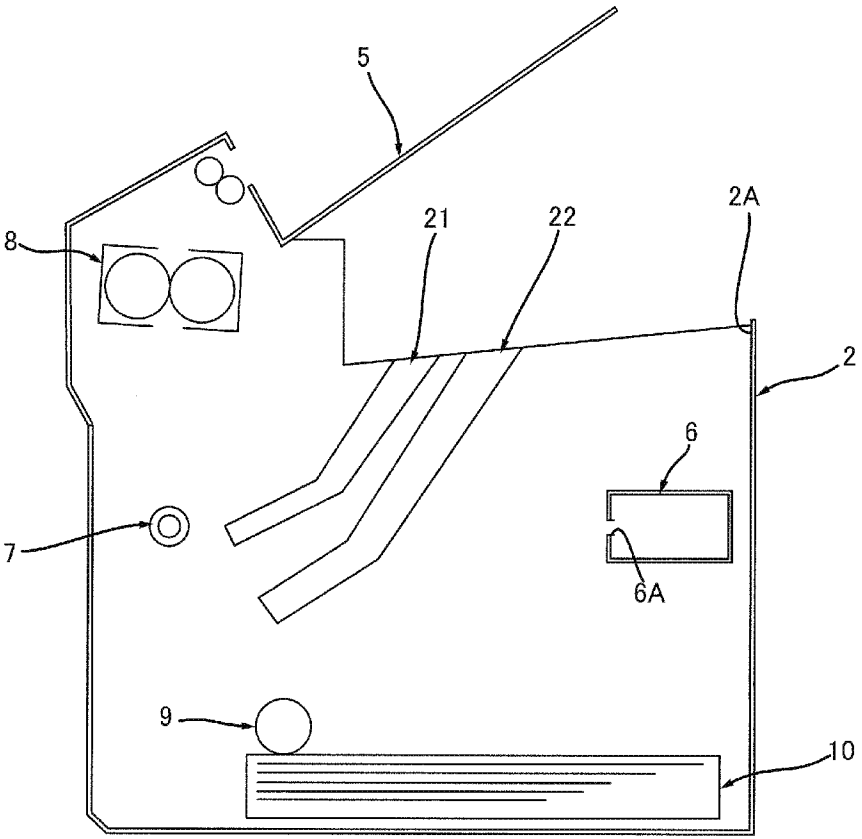
FIG. 2 illustrates a casing depicted in FIG. 1.

As depicted in FIG. 2, the casing 2 includes a drum guide 21 and a developing guide 22.

The drum guide 21 guides the drum cartridge 3 (see FIG. 1) when the drum cartridge 3 is installed in the casing 2. The drum guide 21 is positioned in an inner surface of the casing 2 in the axis direction. The drum guide 21 extends in a drum installation direction. The drum installation direction is a moving direction of the drum cartridge 3 when the drum cartridge 3 is installed in the casing 2.

The developing guide 22 guides the developing cartridge 4 when the developing cartridge 4 (see FIG. 1) is installed in the casing 2. Similar to the drum guide 21, the developing guide 22 is positioned in the inner surface of the casing 2 in the axis direction. The developing guide 22 is positioned between the drum guide 21 and the exposure unit 6. The developing guide 22 extends in a developing installation direction. The developing installation direction is a moving direction of the developing cartridge 4 when the developing cartridge 4 is installed in the casing 2.

Figure 3A:
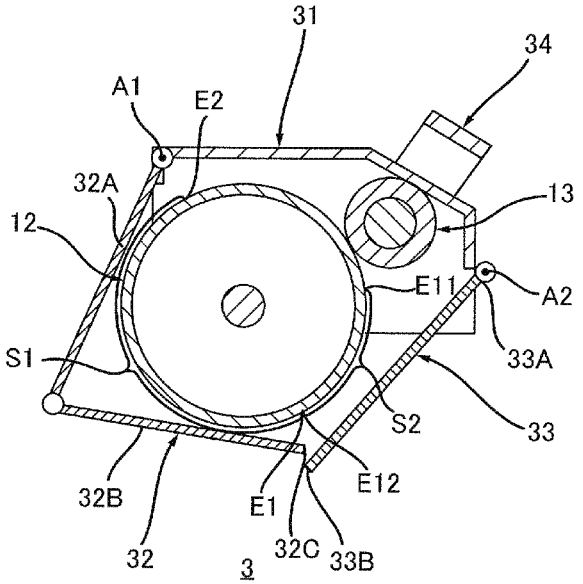
FIG. 3A is a cross-sectional view of a drum cartridge depicted in FIG. 1, wherein a first cover is in a first closed position and a second cover is in a second closed position.
Figure 3B:
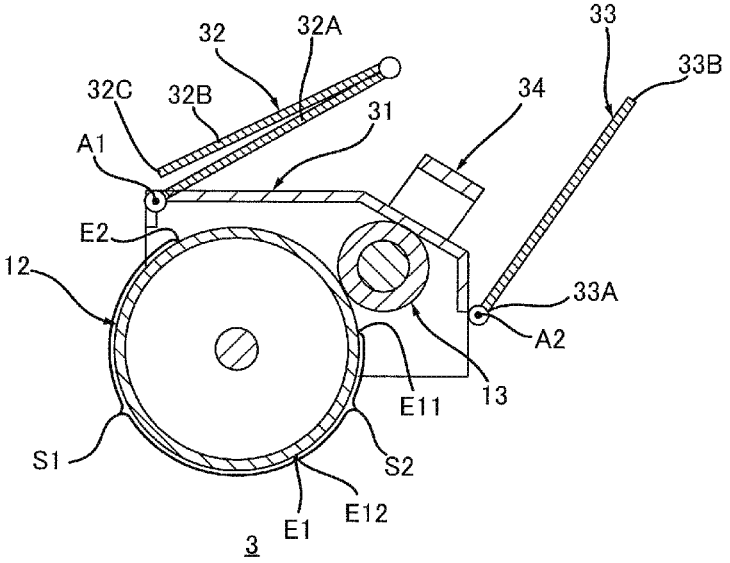
FIG. 3B is the drum cartridge depicted in FIG. 3A, wherein the first cover is in a first open position and the second cover is in a second open position.

As depicted in FIGS. 3A and 3B, the drum cartridge 3 includes the photosensitive drum 12, a frame 31, a first cover 32, a second cover 33, and a handle 34.

The circumferential surface of the photosensitive drum 12 includes a first area S1 and a second area S2.

The first area S1 includes an upstream end E1 and a downstream end E2 in a rotation direction of the photosensitive drum 12. The downstream end E2 is away from the upstream end E1 in the rotation direction of the photosensitive drum 12. The transfer roller 7 is in contact with the first area S1 in the state where the drum cartridge 3 is installed in the casing 2. The first area S1 is positioned on an opposite side of an upstream end E11 of the second area S2 with a downstream end E12 of the second area S2 intervening therebetween in the rotation direction of the photosensitive drum 12. The upstream end E11 and the downstream end E12 are described below.

The second area S2 is adjacent to the first area S1 in the rotation direction of the photosensitive drum 12. Specifically, the second area S2 includes the upstream end E11 and the downstream end E12 in the rotation direction of the photosensitive drum 12. The downstream end E12 is away from the upstream end E11 in the rotation direction of the photosensitive drum 12. The downstream end E12 of the second area S2 continues from the upstream end E1 of the first area S1. The upstream end E11 of the second area S2 is located separately from the downstream end E2 of the first area S1 in the rotation direction of the photosensitive drum 12. The developing roller 14 is in contact with the second area S2 in the state where the drum cartridge 3 and the developing cartridge 4 are installed in the casing 2.

The charging roller 13 is in contact with an area, of the circumferential surface of the photosensitive drum 12, between the downstream end E2 of the first area S1 and the upstream end E11 of the second area S2 in the rotation direction of the photosensitive drum 12.

The frame 31 supports the photosensitive drum 12 and the charging roller 13. The frame 31 extends in the axis direction.

Figure 4:
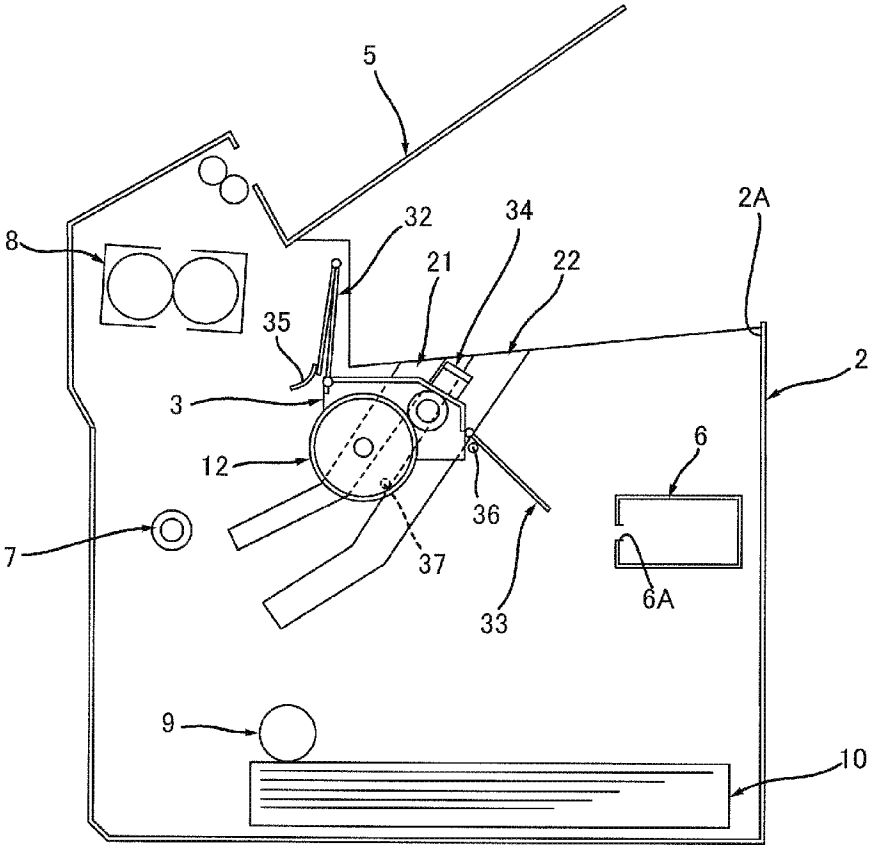
FIG. 4 illustrates installation of the drum cartridge in the casing.

The first cover 32 can pivotally move between a first closed position (see FIG. 3A) where the first cover 32 covers the first area S1 of the photosensitive drum 12 and a first open position (see FIG. 3B) where the first area S1 is exposed. As depicted in FIG. 3A, the first cover 32 is in the first closed position in a state where the drum cartridge 3 is removed from the casing 2. As depicted in FIG. 4, when the drum cartridge 3 is installed in the casing 2, the first cover 32 comes in contact with a first contact part 35 in the casing 2, thus moving from the first closed position to the first open position. The first contact part 35 is designed as appropriate to pivotally move the first cover 32 when the drum cartridge 3 is installed in the casing 2. Specifically, the first contact part 35 is a rib protruding from the inner surface of the casing 2. The first contact part 35 is positioned on an opposite side of the developing guide 22 with respect to the drum guide 21. As depicted in FIG. 1, the first cover 32 is in the first open position in a state where installation of the drum cartridge 3 in the casing 2 is completed.

As depicted in FIGS. 3A and 3B, the first cover 32 can pivotally move with a first axis A1 extending in the axis direction as a pivot center. The first cover 32, which is foldable, is pivotally attached to the frame 31. Specifically, the first cover 32 includes a cover plate 32A and a cover plate 32B. The cover plate 32A is pivotally attached to the frame 31. The cover plate 32B is pivotally attached to the cover plate 32A. The first cover 32 in the first open position is folded so that the cover plate 32B is placed on the cover plate 32A. As depicted in FIG. 1, the first cover 32 folded is positioned between the photosensitive drum 12 and the fixing unit 8 in the state where the drum cartridge 3 is installed in the casing 2. Pivot movement of the cover plate 32B with respect to the cover plate 32A unfolds the first cover 32, namely, the first cover 32 pivotally moves from the first closed position to the first open position. As depicted in FIG. 3A, the first cover 32 unfolded covers the photosensitive drum 12 in the state where the drum cartridge 3 is removed from the casing 2.

The second cover 33 can pivotally move between the second closed position (see FIG. 3A) where the second cover 33 covers the second area S2 of the photosensitive drum 12 and the second open position (see FIG. 3B) where the second area S2 is exposed. A direction in which the second cover 33 pivotally moves from the second closed position to the second open position is opposite to a direction in which the first cover 32 pivotally moves from the first closed position to the first open position. As depicted in FIG.

3A, the second cover 33 is in the second closed position in the state where the drum cartridge 3 is removed from the casing 2. As depicted in FIG. 4, when the drum cartridge 3 is installed in the casing 2, the second cover 33 comes in contact with a second contact part 36 in the casing 2, thus moving from the second closed position to the second open position. The second contact part 36 is designed as appropriate to pivotally move the second cover 33 when the drum cartridge 3 is installed in the casing 2. Specifically, the second contact part 36 is a boss protruding from the inner surface of the casing 2. The second contact part 36 is positioned on an opposite side of the first contact part 35 with the drum guide 21 intervening therebetween. As depicted in FIG. 1, the second cover 33 is kept in the second open position by having contact with a third contact part 37 in the casing 2 in the state where installation of the drum cartridge 3 in the casing 2 is completed. The third contact part 37 is designed as appropriate so that the second cover 33 is kept in the second open position by making the third contact part 37 contact with the second cover 33 in the state where installation of the drum cartridge 3 in the casing 2 is completed. Specifically, the third contact part 37 is a boss protruding from the inner surface of the casing 2. The third contact part 37 is positioned on an opposite side of the first contact part 35 with the drum guide 21 intervening therebetween. The third contact part 37 is positioned downstream of the second contact part 36 in the drum installation direction.

As depicted in FIGS. 3A and 3B, the second cover 33 can pivotally move with a second axis A2 extending in the axis direction as a pivot center. The second cover 33, which has a flat plate shape, is pivotally attached to the frame 31. As depicted in FIG. 1, the second cover 33 is positioned between the handle 34 and the exposure unit 6 in the state where installation of the drum cartridge 3 in the casing 2 is completed, namely, in a state where the second cover 33 is in the second open position. Further, as depicted in FIG. 3A, an end 33B (hereinafter also referred to as a second end 33B) of the second cover 33 in a circumference direction of the photosensitive drum 12 overlaps with the first cover 32 in the state where the drum cartridge 3 is removed from the casing 2, namely, in a state where the first cover 32 is in the first closed position and the second cover 33 is in the second closed position. Specifically, the second cover 33 includes a first end 33A that is pivotally attached to the frame 31 in the circumference direction of the photosensitive drum 12 and the second end 33B positioned on an opposite side of the frame 31 with the first end 33A intervening therebetween. The second end 3313 of the second cover 33 overlaps with an end 32C of the first cover 32 in the state where the first cover 32 is in the first closed position and the second cover 33 is in the second closed position. In other words, the end 32C of the first cover 32 is positioned between the second end 33B of the second cover 33 and the photosensitive drum 12 in a diameter direction of the photosensitive drum 12 in the state where the first cover 32 is in the first closed position and the second cover 33 is in the second closed position. The second end 33B of the second cover 33 may be positioned between the end 32C of the first cover 32 and the photosensitive drum 12 in the diameter direction of the photosensitive drum 12 in the state where the first cover 32 is in the first closed position and the second cover 33 is in the second closed position. This allows the first cover 32 and the second cover 33 to entirely cover the circumferential surface of the photosensitive drum 12 in the circumference direction of the photosensitive drum 12 in the state where the drum cartridge 3 is removed from the casing 2.

In the state where the first cover 32 is in the first closed position and the second cover 33 is in the second closed position, the second end 33B of the second cover 33 may in contact with the end 32C of the first cover 32 or the second end 33B may be separated from the end 32C at such an interval that a finger of a user or the like can not be inserted therein.

A user holds the handle 34 when attaching the drum cartridge 3 in the casing 2 or removing the drum cartridge 3 from the casing 2. The handle 34 protrudes from the frame 31. As depicted in FIG. 1, the handle 34 is positioned between the first cover 32 in the first open position and the second cover 33 in the second open position in the state where the drum cartridge 3 is installed in the casing 2. A distance D between the first cover 32 in the first open position and the second cover 33 in the second open position is equal to or more than 10 mm and equal to and less than 20 mm. Making the distance D equal to or more than the lower limit value (i.e., equal to or more than 10 mm) results in a space between the first cover 32 in the first open position and the second cover 33 in the second open position, allowing a hand of the user to enter therein. Making the distance D equal to or less than the upper limit value (i.e., equal to and less than 20 mm) allows the first cover 32 and the second cover 33 to be arranged compactly in the state where the drum cartridge 3 is installed in the casing 2.

<Action and Effect of First Embodiment>

As depicted in FIG. 3A, the circumferential surface of the photosensitive drum 12 can be covered with the first cover 32 and the second cover 33, of the drum cartridge 3, pivotally moving in mutually opposite directions.

In the configuration of the first embodiment, positioning the first cover 32 in the first closed position and positioning the second cover 33 in the second closed position protect the circumferential surface of the photosensitive drum 12 in the state where the drum cartridge 3 is removed from the casing 2.

In the image forming apparatus 1 of the first embodiment, the drum cartridge 3 and the developing cartridge 4 are installable in the casing 2 independently from each other.

In the photosensitive drum 12 of the first embodiment, the first area S1 is in contact with the transfer roller 7 and the second area S2 is in contact with the developing roller 14 in the state where the drum cartridge 3 is installed in the casing 2.

In the configuration of the first embodiment, if no cover for the circumferential surface of the photosensitive drum 12 is provided, a large part of the circumferential surface of the photosensitive drum 12 including the first area S1 and the second area S2 would be exposed in the state where the drum cartridge 3 is removed from the casing 2, damaging and contaminating the circumferential surface of the photosensitive drum 12.

The drum cartridge 3 of the first embodiment, however, includes the first cover 32 for the first area S1 and the second cover 33 for the second area S2, which allows the circumferential surface of the photosensitive drum 12 to be protected securely.

<Second Embodiment>

Figure 5:
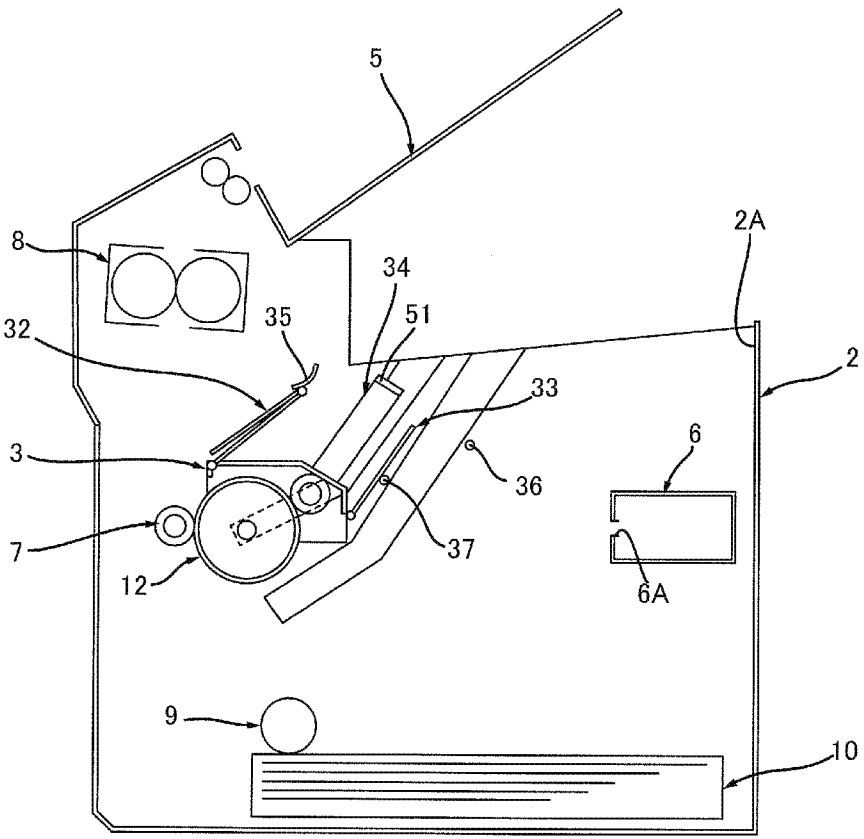
FIG. 5 is an illustrative view of a second embodiment.

Referring to FIG. 5, a second embodiment is explained. The constitutive parts or components, which are the same as or equivalent to those of the first embodiment, are designated by the same reference numerals, any explanation thereof will be omitted as appropriate.

As depicted in FIG. 5, at least a part of the handle 34 may be positioned above the second cover 33 in the second open position in the state where the drum cartridge 3 is installed in the casing 2. A grip 51 of the handle 34 may be preferably positioned above the second cover 33 in the second open position in the state where the drum cartridge 3 is installed in the casing 2.

In the second embodiment, the user can easily hold the handle 34 in the state where the second cover 33 is in the second open position.

The second embodiment can obtain the same action and effect of those of the first embodiment.

<Third Embodiment>

Figure 6:
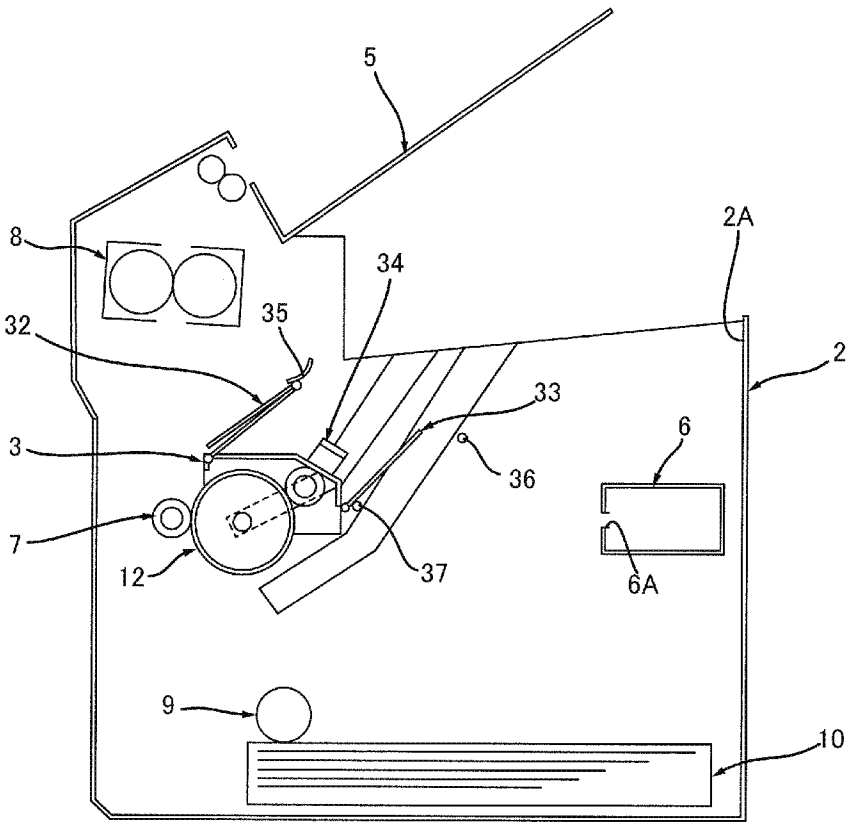
FIG. 6 is an illustrative view of a third embodiment, wherein the second cover is positioned between the second closed position and the second open position.
Figure 7:
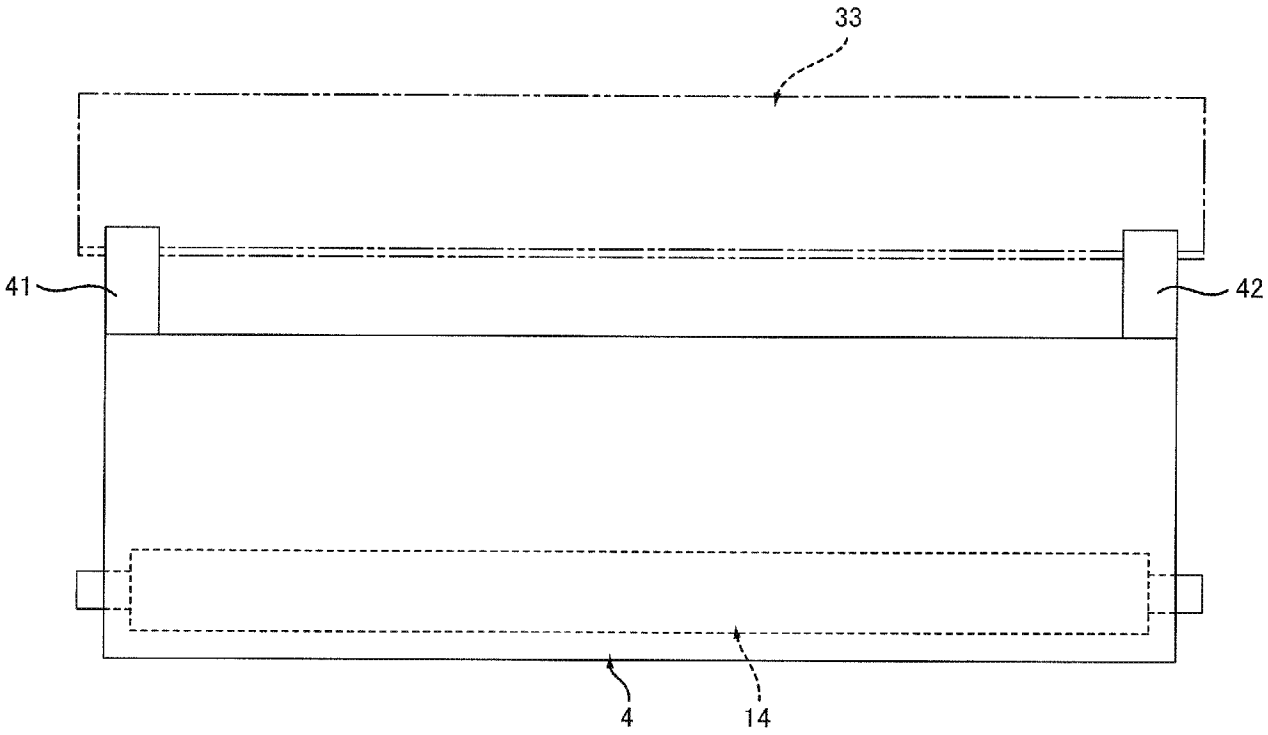
FIG. 7 is another illustrative view of the third embodiment, wherein a first protrusion and a second protrusion of the developing cartridge are in contact with the second cover.

Referring to FIGS. 6 and 7, a third embodiment is explained. The constitutive parts or components, which are the same as or equivalent to those of the first and second embodiments, are designated by the same reference numerals, any explanation thereof will be omitted as appropriate.

As depicted in FIG. 6, the second cover 33 may be positioned between the second open position and the second closed position in a state where the drum cartridge 3 is installed in the casing 2 and the developing cartridge 4 is removed from the casing 2.

In that case, as depicted in FIG. 7, the developing cartridge 4 may include a first protrusion 41 and a second protrusion 42. The second protrusion 42 is positioned separately from the first protrusion 41 in a rotation axis direction of the developing roller 14. The light L (FIG. 1) emitted from the exposure unit 6 passes between the first protrusion 41 and the second protrusion 42 in the axis direction.

When the developing cartridge 4 is installed in the casing 2, the second cover 33 may move toward the second open position from the position between the second closed position and the second open position by coining contact with the developing cartridge 4. Specifically, when the developing cartridge 4 is installed in the casing 2, the second cover 33 may move toward the second open position from the position between the second closed position and the second open position by coming contact with the first protrusion 41 and the second protrusion 42.

In the third embodiment, the second cover 33 is in the second open position in the state where the drum cartridge 3 and the developing cartridge 4 are installed in the casing 2.

The third embodiment can obtain the same action and effect of those of the first and second embodiments.

<Fourth Embodiment>

Referring to FIGS. 8A to 10, a fourth embodiment is explained. The constitutive parts or components, which are the same as or equivalent to those of the above embodiments, are designated by the same reference numerals, any explanation thereof will be omitted as appropriate.

Figure 8A:
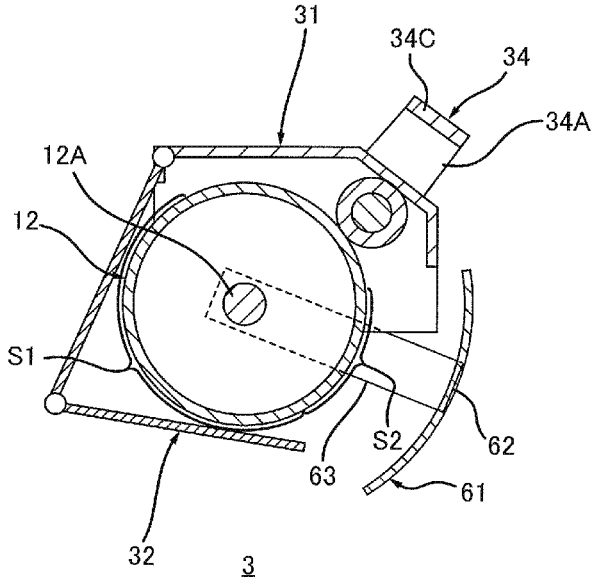
FIG. 8A is a cross-sectional view of the drum cartridge of a fourth embodiment, wherein the first cover is in the first closed position and the second cover is in the second closed position.
Figure 8B:
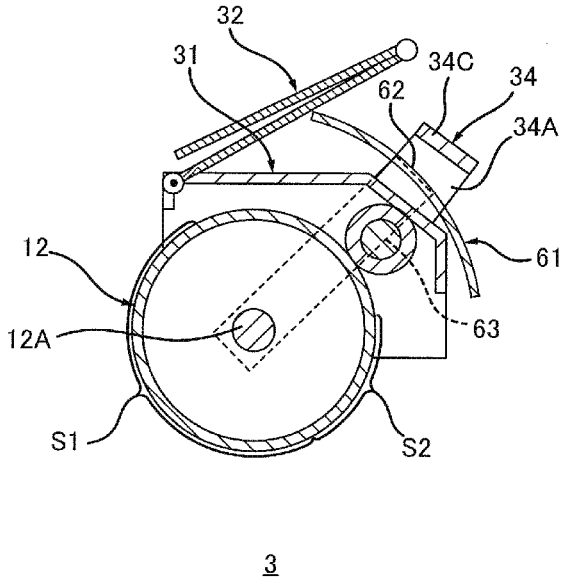
FIG. 8B depicts the drum cartridge depicted in FIG. 8A, wherein the first cover is in the first open position and the second cover is in the second open position.

As depicted in FIGS. 8A and 8B, a second cover 61 may include a covering part 62 for covering the second area S2 of the photosensitive drum 12. The second cover 61 may pivotally move between the second closed position and the second open position so that the covering part 62 moves along the circumferential surface of the photosensitive drum 12. In that case, as depicted in FIG. 8B, the covering part 62 of the second cover 61 may be positioned between the frame 31 and a third portion 34C of the handle 34 in a state where the second cover 61 is in the second open position.

Details of the fourth embodiment are explained below

Figure 9:
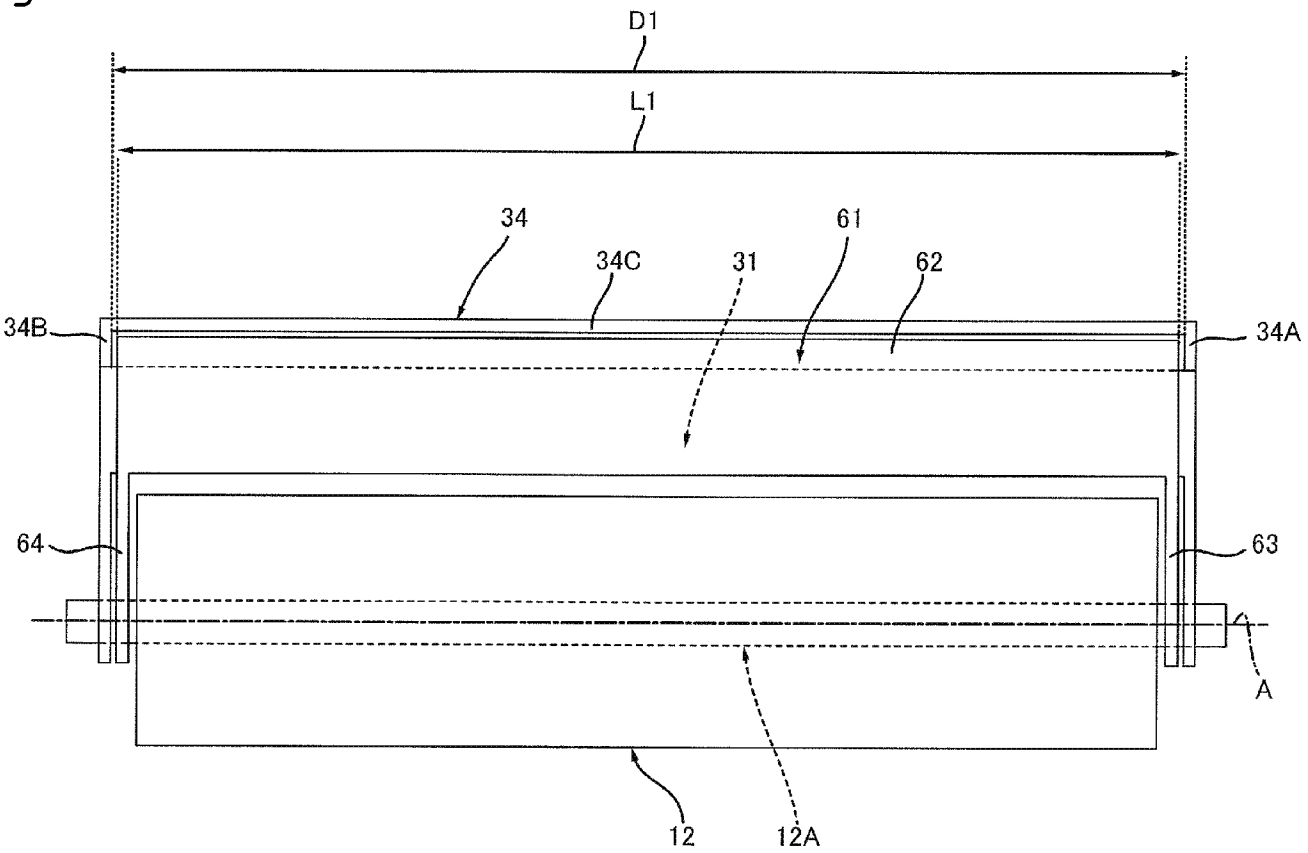
FIG. 9 is a side view of the drum cartridge depicted in FIG. 8B when seen from an opposite side of the first cover with respect to the second cover.

As depicted in FIG. 9, the handle 34 includes a first portion 34A, a second portion 34B, and the third portion 34C.

The first portion 34A extends from the frame 31.

The second portion 34B is positioned separately from the first portion 34A in the axis direction. The second portion 34B extends from the frame 31.

The third portion 34C is a grip held by the user when the drum cartridge 3 is installed in the casing 2 or when the drum cartridge 3 is removed from the casing 2. The third portion 34C, which extends in the axis direction, is positioned between the first portion 34A and the second portion 34B in the axis direction. The third portion 34C connects the first portion 34A and the second portion 34B. The third portion 34C is positioned separately from the frame 31.

As depicted in FIG. 8A, the second cover 61 includes the covering part 62, a first arm 63, and a second arm 64 (see FIG. 9).

As depicted in FIG. 9, the covering part 62 is positioned between the first arm 63 and the second arm 64 in the axis direction. The covering part 62 extends in the axis direction. The covering part 62 also extends in the circumference direction of the photosensitive drum 12. The covering part 62 has an arc shape when seen from the axis direction.

As depicted in FIG. 9, a length L of the covering part 62 in the axis direction may be shorter than a distance D1 between the first portion 34A and the second portion 34B in the axis direction. In that case, the covering part 62 is positioned between the first portion 34A and the second portion 34B of the handle 34 in the axis direction in the state where the second cover 61 is in the second open position.

Figure 10:
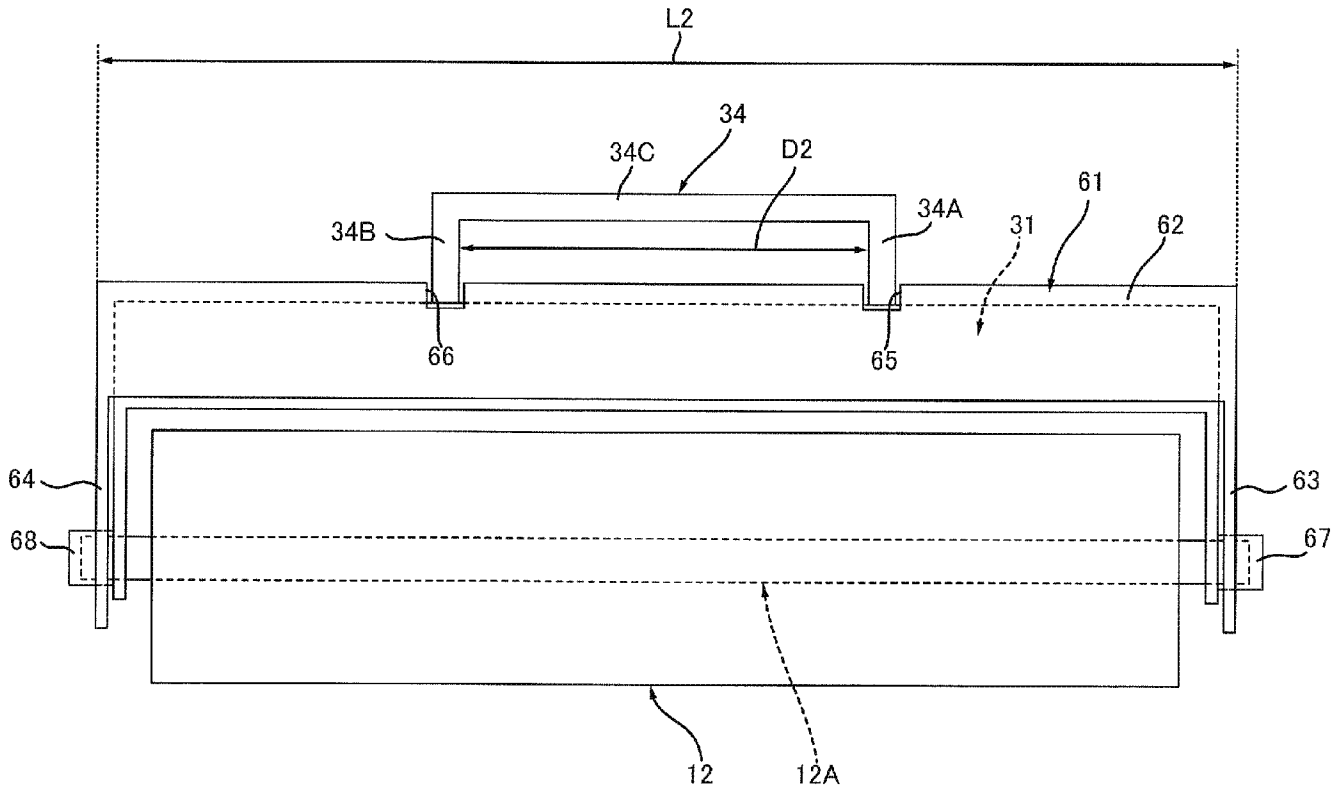
FIG. 10 is a modified example of the drum cartridge depicted in FIG. 9.

As depicted in FIG. 10, a length L2 of the covering part 62 in the axis direction may be longer than a distance D2 between the first portion 34A and the second portion 34B in the axis direction. In that case, the covering part 62 includes a first concave portion 65 and a second concave portion 66. The first portion 34A of the handle 34 is fitted into the first concave portion 65 in the state where the second cover 61 is in the second open position. The second portion 34B of the handle 34 is fitted into the second concave portion 66 in the state where the second cover 61 is in the second open position.

As depicted in FIG. 9, the second cover 61 may be pivotally supported by a drum shaft 12A of the photosensitive drum 12. The drum shaft 12A, which has a cylindrical shape, extends in the axis direction. In that case, the first arm 63 connects the covering part 62 and a first end of the drum shaft 12A in the axis direction. Specifically, the first arm 63 connects a first end of the covering part 62 in the axis direction and the first end of the drum shaft 12A in the axis direction. The second arm 64 connects the covering part 62 and a second end of the drum shaft 12A in the axis direction. Specifically, the second arm 64 is positioned separately from the first arm 63 in the axis direction. The second arm 64 connects a second end of the covering part 62 in the axis direction and the second end of the drum shaft 12A in the axis direction.

As depicted in FIG. 10, the second cover 61 may be pivotally supported by a first shaft 67 that extends from a first end of the frame 31 in the axis direction and a second shaft 68 that extends from a second end of the frame 31 in the axis direction. Specifically, the drum cartridge 3 includes the first shaft 67 that extends from the first end of the frame 31 in the axis direction and the second shaft 68 that extends from the second end of the frame 31 in the axis direction.

The first shaft 67, which has a cylindrical shape, extends in the axis direction. The first arm 63 is pivotally connected to the first shaft 67. Namely, the first arm 63 connects the covering part 62 and the first shaft 67. This allows the first shaft 67 to pivotally support the second cover 61.

The second shaft 68 is positioned separately from the first shaft 67 in the axis direction. The second shaft 68, which has a cylindrical shape, extends in the axis direction. The second arm 64 is pivotally connected to the second shaft 68.

Namely, the second arm 64 connects the covering part 62 and the second shaft 68. This allows the second shaft 68 and the first shaft 67 to pivotally support the second cover 61.

The fourth embodiment can obtain the same action and effect of those of the above embodiments.

The embodiments disclosed above should be considered as exemplary, but not as limitary in each and every aspect. The image forming apparatus according to the present disclosure is not limited to the above embodiments, and a variety of modification and changes may be added to the image forming apparatus in a range not departing from the gist of the present disclosure. For example, the image forming apparatus according to the present disclosure is not limited to the printer, but applicable to facsimile machines, copying machines, multifunction peripherals, and the like. It is possible to mutually combine the technical characteristics described in the embodiments as needed.

What is claimed is:

1. An image forming apparatus comprising:

a casing;

a drum cartridge being installable in the casing and including:

a photosensitive drum of which a circumferential surface includes a first area and a second area;

a first cover configured to pivotally move between a first closed position and a first open position, the first closed position being a position where the first cover covers the first area of the photosensitive drum, the first open position being a position where the first area is exposed; and a second cover configured to pivotally move between a second closed position and a second open position, the second closed position being a position where the second cover covers the second area of the photosensitive drum, and the second open position being a position where the second area is exposed; and a developing cartridge being installable in the casing independently of the drum cartridge, wherein a direction in which the second cover pivotally moves from the second closed position to the second open position is opposite to a direction in which the first cover pivotally moves from the first closed position to the first open position, and wherein, in a case that the developing cartridge is installed in the casing, the second cover is configured to move from the position between the second closed position and the second open position to the second open position by coming into contact with the developing cartridge.

2. The image forming apparatus according to claim 1, wherein the developing cartridge includes a developing roller configured to make contact with the second area of the photosensitive drum in a state where the drum cartridge and the developing cartridge are installed in the casing.

3. The image forming apparatus according to claim 2, wherein the developing cartridge includes a first protrusion and a second protrusion, which is positioned away from the first protrusion in a rotation axis direction of the developing roller, and in the case that the developing cartridge is installed in the casing, the second cover is configured to move from the position between the second closed position and the second open position to the second open position by coming into contact with the first protrusion and the second protrusion.

4. The image forming apparatus according to claim 1, further comprising a transfer roller configured to make contact with the first area of the photosensitive drum in a state where the drum cartridge is installed in the casing.

5. The image forming apparatus according to claim 1, wherein the first area is arranged side-by-side with the second area in a rotation direction of the photosensitive drum.

6. The image forming apparatus according to claim 1, wherein the second area includes an upstream end and a downstream end in a rotation direction of the photosensitive drum, the downstream end being positioned away from the upstream end, and the first area is positioned on an opposite side of the upstream end with respect to the downstream end in the rotation direction of the photosensitive drum.

7. The image forming apparatus according to claim 1, wherein the first cover is configured to pivotally move around a first axis extending in an axis direction in which a rotation axis of the photosensitive drum extends, and the second cover is configured to pivotally move around a second axis extending in the axis direction.

8. The image forming apparatus according to claim 1, wherein the second cover is configured to:

be positioned between the second closed position and the second open position in a state where the drum cartridge is installed in the casing and the developing cartridge is removed from the casing, and be positioned in the second open position in the state where the drum cartridge and the developing cartridge are installed in the casing.

9. An image forming apparatus comprising:

a casing; and a drum cartridge being installable in the casing and including:

a photosensitive drum of which a circumferential surface includes a first area and a second area;

a first cover configured to pivotally move between a first closed position and a first open position, the first closed position being a position where the first cover covers the first area of the photosensitive drum, the first open position being a position where the first area is exposed;

a second cover configured to pivotally move between a second closed position and a second open position, the second closed position being a position where the second cover covers the second area of the photosensitive drum, and the second open position being a position where the second area is exposed; and a handle configured so that at least a part of the handle is positioned above the second cover in the second open position in a state where the drum cartridge is installed in the casing wherein a direction in which the second cover pivotally moves from the second closed position to the second open position is opposite to a direction in which the first cover pivotally moves from the first closed position to the first open position.

10. The image forming apparatus according to claim 9, wherein the handle is positioned between the first cover in the first open position and the second cover in the second open position, and a distance between the first cover in the first open position and the second cover in the second open position is equal to or more than 10 mm and equal to or less than 20 mm.

11. An image forming apparatus comprising:

a casing; and a drum cartridge being installable in the casing and including:

a photosensitive drum of which a circumferential surface includes a first area and a second area;

a first cover configured to pivotally move between a first closed position and a first open position, the first closed position being a position where the first cover covers the first area of the photosensitive drum, the first open position being a position where the first area is exposed; and a second cover configured to pivotally move between a second closed position and a second open position, the second closed position being a position where the second cover covers the second area of the photosensitive drum, and the second open position being a position where the second area is exposed; and an exposure unit configured to expose the photosensitive drum by emitting light which passes below the second cover in the second open position to enter the photosensitive drum, wherein a direction in which the second cover pivotally moves from the second closed position to the second open position is opposite to a direction in which the first cover pivotally moves from the first closed position to the first open position, wherein the drum cartridge includes a handle, and wherein the second cover in the second open position is positioned between the handle and the exposure unit.

12. An image forming apparatus comprising:

a casing; and a drum cartridge being installable in the casing and including:

a photosensitive drum of which a circumferential surface includes a first area and a second area;

a first cover configured to pivotally move between a first closed position and a first open position, the first closed position being a position where the first cover covers the first area of the photosensitive drum, the first open position being a position where the first area is exposed;

a second cover configured to pivotally move between a second closed position and a second open position, the second closed position being a position where the second cover covers the second area of the photosensitive drum, and the second open position being a position where the second area is exposed; and a frame supporting the photosensitive drum and a handle extending from the frame, the handle including:

a first portion extending from the frame;

a second portion extending from the frame and positioned away from the first portion in an axis direction in which a rotation axis of the photosensitive drum extends; and a third portion positioned away from the frame, connecting the first portion and the second portion, and positioned between the first portion and the second portion in the axis direction to extend in the axis direction, wherein a direction in which the second cover pivotally moves from the second closed position to the second open position is opposite to a direction in which the first cover pivotally moves from the first closed position to the first open position, and wherein the second cover in the second open position is positioned between the frame and the third portion of the handle.

13. The image forming apparatus according to claim 12, wherein the drum cartridge includes a first shaft pivotally supporting the second cover and a second shaft being positioned away from the first shaft in the axis direction and pivotally supports the second cover together with the first shaft, and the second cover includes:

a covering part configured to cover the second area of the photosensitive drum in a state where the second cover is positioned in the second closed position, the covering part being positioned between the frame and the third portion of the handle in a state where the second cover is positioned in the second open position;

a first arm connecting the covering part and the first shaft; and a second arm connecting the covering part and the second shaft.

14. The image forming apparatus according to claim 13, wherein the covering part is configured to move along the circumferential surface of the photosensitive drum in the case that the second cover pivotally moves between the second closed position and the second open position.

15. The image forming apparatus according to claim 13, wherein a length of the covering part in the axis direction is shorter than a distance between the first portion and the second portion in the axis direction, and the covering part is positioned between the first portion and the second portion in the axis direction in the state where the second cover is positioned in the second open position.

16. The image forming apparatus according to claim 13, wherein a length of the covering part in the axis direction is longer than a distance between the first portion and the second portion in the axis direction, and the covering part includes:

a first concave portion into which the first portion is fitted in the state where the second cover is positioned in the second open position, and a second concave portion into which the second portion is fitted in the state where the second cover is positioned in the second open position.

17. The image forming apparatus according to claim 12, wherein the photosensitive drum includes a drum shaft pivotally supporting the second cover and extending in the axis direction, the second cover includes:

a covering part configured to cover the second area of the photosensitive drum in a state where the second cover is positioned in the second closed position, the covering part being positioned between the frame and the third portion of the handle in a state where the second cover is positioned in the second open position;

a first arm connecting the covering part and a first end of the drum shaft in the axis direction; and a second arm connecting the covering part and a second end of the drum shaft in the axis direction.

18. An image forming comprising:

a casing; and a drum cartridge being installable in the casing and including:

a photosensitive drum of which a circumferential surface includes a first area and a second area;

a first cover configured to pivotally move between a first closed position and a first open position, the first closed position being a position where the first cover covers the first area of the photosensitive drum, the first open position being a position where the first area is exposed; and a second cover configured to pivotally move between a second closed position and a second open position, the second closed position being a position where the second cover covers the second area of the photosensitive drum, and the second open position being a position where the second area is exposed, wherein a direction in which the second cover pivotally moves from the second closed position to the second open position is opposite to a direction in which the first cover pivotally moves from the first closed position to the first open position, and wherein an end of the second cover in a circumference direction of the photosensitive drum overlaps with the first cover in a state where the first cover is positioned in the first closed position and the second cover is positioned in the second closed position.

19. A drum cartridge comprising:

a photosensitive drum including a circumferential surface having a first area and a second area;

a first cover configured to pivotally move between a first closed position and a first open position, the first closed position being a position where the first cover covers the first area of the photosensitive drum, the first open position being a position where the first area is exposed;

a second cover configured to pivotally move between a second closed position and a second open position, the second closed position being a position where the second cover covers the second area of the photosensitive drum, the second open position being a position where the second area is exposed;

a frame supporting the photosensitive drum; and a handle extending from the frame, wherein the handle includes:

a first portion extending from the frame;

a second portion extending from the frame and positioned away from the first portion in an axis direction in which a rotation axis of the photosensitive drum extends; and a third portion positioned away from the frame, connecting the first portion and the second portion, and positioned between the first portion and the second portion in the axis direction to extend in the axis direction, wherein a direction in which the second cover pivotally moves from the second closed position to the second open position is opposite to a direction in which the first cover pivotally moves from the first closed position to the first open position; and wherein the second cover in the second open position is positioned between the frame and the third portion of the handle.

* * * * *